US007315111B2

(12) United States Patent
Song et al.

(10) Patent No.: US 7,315,111 B2
(45) Date of Patent: Jan. 1, 2008

(54) SUPPORTING SPACERS OF A FLAT DISPLAY DEVICE

(75) Inventors: Byong-Gwon Song, Seoul (KR); Moon-Jin Shin, Iksan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 190 days.

(21) Appl. No.: 10/994,667

(22) Filed: Nov. 23, 2004

(65) Prior Publication Data

US 2005/0110383 A1 May 26, 2005

(30) Foreign Application Priority Data

Nov. 25, 2003 (KR) ..... 10-2003-0084181

(51) Int. Cl.

| | |
|---|---|
| ***H01J 1/88*** | (2006.01) |
| ***H01J 1/00*** | (2006.01) |
| ***H01J 1/62*** | (2006.01) |
| *H01J 9/00* | (2006.01) |
| *H01J 9/24* | (2006.01) |

(52) U.S. Cl. ..... 313/292; 313/495; 313/238; 313/497

(58) Field of Classification Search ..... 313/256–261, 313/286–292, 238, 495–497
See application file for complete search history.

(56) References Cited

U.S. PATENT DOCUMENTS

| | | | | |
|---|---|---|---|---|
| 5,980,346 | A * | 11/1999 | Anderson et al. | 445/24 |
| 6,593,682 | B2 * | 7/2003 | Jung et al. | 313/292 |
| 6,741,027 | B1 * | 5/2004 | Cummings et al. | 313/495 |
| 6,803,715 | B1 * | 10/2004 | Mitsutake et al. | 313/495 |
| 6,927,533 | B1 * | 8/2005 | Ito et al. | 313/495 |

* cited by examiner

*Primary Examiner*—Nimeshkumar D. Patel
*Assistant Examiner*—Peter Macchiarolo
(74) *Attorney, Agent, or Firm*—Robert E. Bushnell, Esq.

(57) ABSTRACT

A spacer supporting structure includes: a plurality of bar-shaped spacers adapted to maintain a gap between two panels; a first supporting member adapted to fix an end part of the spacer, the first supporting member being arranged on an edge of one of the two panels; a second supporting member arranged on another edge of the one of the two panels; and a plurality of elastic members arranged on the second supporting member, the plurality of elastic members adapted to apply a tensile force to the respective spacers by being coupled to the second ends of the spacers.

27 Claims, 10 Drawing Sheets

SUPPORTING SPACERS OF A FLAT DISPLAY DEVICE

CLAIM OF PRIORITY

This application makes reference to, incorporates the same herein, and claims all benefits accruing under 35 U.S.C. §119 from an application for SPACER SUPPORTING STRUCTURE FOR FLAT DISPLAY DEVICE AND METHOD OF SUPPORTING SPACERS earlier filed in the Korean Intellectual Property Office on 25 Nov. 2003 and there duly assigned Serial No. 2003-84181.

BACKGROUND OF THE INVENTION

1. Field of the Invention

The present invention relates to a flat display device, and more particularly, to a spacer supporting structure for a flat display device adapted to maintain a gap between two panels of the flat display device and a method of supporting spacers.

2. Description of the Related Art

Typical important applications of display devices include monitors for personal computers and television screens. The display devices include Cathode Ray Tubes (CRTs), which use the emission of heated electrons at a high speed, and flat display devices, which have rapidly developed in recent years, such as Liquid Crystal Displays (LCDs), Plasma Display Panels (PDPs), and Field Emission Displays (FEDs).

The flat display devices, such as FEDs, have electrons emitted in a vacuum space and light generated by a fluorescent material excited by the emitted electrons. The flat display devices include a front panel, a rear panel, and spacers between the front panel and the rear panel. The FED includes a stacked structure including an anode and a fluorescent layer arranged on the front panel, and an electron emitter, such as a micro tip or a Carbon NanoTube (CNT), a cathode and a gate electrode for controlling electron emission arranged on the rear panel.

The space between the front panel and the rear panel is maintained in a vacuum state. Therefore, the front panel and the rear panel are apt to deform due to atmospheric pressure or other external pressure. In this case, components between the two panels can be damaged, especially when a gap between the front panel and the rear panel becomes uneven due to a deformation, in which case the electron emission and the control of the emission may be impossible.

Therefore, the gap between the front panel and the rear panel of a flat display device such as a FED should remain fixed. For this purpose, spacers are interposed between the two panels. The spacers should be located at positions that do not interfere with the display of an image.

A cross-shaped spacer and a bar-shaped spacer are widely used in flat display devices.

The cross-shaped spacer is manufactured piece by piece by etching or injection molding. In order to maintain the gap between the front panel and the rear panel, the cross-shaped spacer is required to dispose about one~five pieces per square centimeter. Generally, the cross-shaped spacer is mounted by an adhesive on the rear panel. More specifically, a small amount of the adhesive is coated on the rear panel or on the spacer and then the spacer is attached to the rear panel.

The cross-shaped spacer can be attached to a correct location on the rear panel since it is mounted piece by piece, and almost no deformation is observed after sealing at a high temperature during the manufacturing process of flat display devices.

However, mounting the numerous cross-shaped spacers on the rear panel of a large flat display device can take a long time. Also, the rear panel can be contaminated by the adhesive used to attach the cross-shaped spacers, and the contamination of the rear panel can degrade the image quality of the flat display device.

A bar-shaped spacer is manufactured by cutting a ceramic sheet or a glass sheet into a bar shape with desired dimensions. The bar-shaped spacer is mounted by attaching both ends of the bar-shaped spacer to a separately prepared fixture using an adhesive.

The bar-shaped spacer is easily manufactured and requires a short installation time. Also, there is little possibility of contamination of an active region of the panel since the adhesive is only applied to the ends of the bar-shaped spacer.

However, the bar-shaped spacer is not well suited to a high temperature sealing process since it only has support along one dimension. More specifically, the panel and the bar-shaped spacer expand and contract by different amounts during and after the high temperature sealing process because they have different thermal expansion coefficients. Therefore, the bar-shaped spacer can bend. If so, the bar-shaped spacer may not remain in the correct position, resulting in misalignment of the bar-shaped spacers, cathodes, and anodes.

A protrusion of a contact portion between a spacer and the rear panel into a pixel region can occur due to a misalignment of a bar-shaped spacer after a high temperature sealing process. When there is a misalignment of a bar-shaped spacer, the spacer may cover a pixel or interact with an electron beam between anodes and cathodes, which can cause a bright spot due to an electron charging effect, or can cause arcing due to a partial distortion of an electric field.

To minimize an alignment error of the spacers, cathodes and anodes caused by the thermal expansion coefficient differences, only one end of the spacers is fixed. In this case, the problems associated with the thermal expansion coefficient differences are reduced to some degree since the thermal expansion and contraction of the bar-shaped spacer is relatively free. However, since the spacers are fixed only at one end, the alignment can easily be distorted by the flow of an inert gas injected between the two panels to prevent an oxidation of an electron emitter at a high temperature.

SUMMARY OF THE INVENTION

The present invention provides a spacer supporting structure that can maintain a gap between two panels of a flat display device and can minimize an alignment error of spacers during a high temperature process and a method of supporting spacers.

According to one aspect of the present invention, a spacer supporting structure of a flat display device including two panels is provided, the spacer supporting structure comprising: a plurality of bar-shaped spacers; a first supporting member adapted to fix first ends of the spacers, the first supporting member arranged at an edge of one of the two panels; a second supporting member arranged on another edge of the one of the two panels; and a plurality of elastic members arranged on the second supporting member, the plurality of elastic members being coupled to second ends of the spacers and adapted to apply a tensile force to respective spacers.

The spacer supporting structure preferably further comprises a groove arranged in the first supporting member, the first end of the each of the spacers being inserted and fixed in the groove.

Each of the elastic members preferably comprises a leaf spring, one end thereof being fixed to the second supporting member and another end thereof being coupled to the second end of one of the spacers.

Each of the elastic members preferably has an omega shape.

The second supporting member preferably comprises grooves adapted to support ends of the leaf springs, the ends of each leaf spring being inserted into respective grooves.

Each of the elastic members preferably comprises a wing shape leaf spring, one end thereof being fixed to the second supporting member and a central part thereof being coupled to the second end of one of the spacers.

The spacer supporting structure preferably further comprises an inserting groove arranged in the second supporting member, wherein one of the elastic members is adapted to being inserted into the inserting groove, and further comprising a mounting groove adapted to support an end of one of the leaf springs, the end of the one of the leaf spring being inserted into the mounting groove and arranged on a corner portion of the inserting groove.

The spacer supporting structure preferably further comprises a plurality of guides adapted to guide the respective spacers so as not to deviate from an expansion direction, the plurality of guides being respectively arranged adjacent to the second ends of the spacers.

The plurality of guides preferably comprise guide members protruding from respective surfaces of the second supporting members, the guide members being arranged adjacent to a side of the respective spacers.

Each of the guide members preferably comprises a unitary structure with the second supporting member.

Each of the first and second supporting members is preferably attached to a surface of the panel parallel to an edge of an active region of the panel.

The first and the second supporting members preferably comprise the same material as the panel.

The first and the second supporting members preferably comprise glass.

Each end of the spacers preferably comprises a coupling portion.

Each spacer preferably comprises a plurality of regularly spaced grooves along its length.

According to another aspect of the present invention, a spacer supporting structure of a flat display device including two panels is provided, the spacer supporting structure comprising: a plurality of bar-shaped spacers; a rectangular shaped frame adapted to surround an active region of one of the two panels; a plurality of supporting members adapted to fix respective first ends of the spacers, the plurality of supporting members being arranged on a side of the frame; and a plurality of elastic members arranged on another side of the frame, the plurality of elastic members being coupled to the second ends of the spacers and adapted to apply a tensile force to the respective spacers.

Each of the plurality of supporting members preferably comprises a supporting groove adapted to support the respective spacer, the first end of each spacer being arranged in its respective groove, and wherein the plurality of supporting members comprise a unitary structure with the frame.

Each of the plurality of elastic members preferably comprises a leaf spring, first ends thereof being fixed to another side of the frame and second ends thereof being respectively coupled to the second ends of the respective spacers.

The leaf springs preferably comprise a unitary structure with the frame.

The spacer supporting structure preferably further comprises a plurality of guides adapted to guide the respective spacers so as not to deviate from an expansion direction, the plurality of guides being respectively arranged adjacent to the second ends of the spacers.

The plurality of guides preferably comprise guide members protruding from surfaces of the another side of the frame adjacent to a side of the respective spacers spacer.

The guide members are preferably formed by cutting and bending the frame.

The frame preferably comprises a metal.

The frame preferably comprises one of Invar and a nickel alloy.

The frame on which the spacers are mounted is preferably arranged around the active region of the panel.

Each of the end parts of the spacers preferably comprises a coupling portion.

Each spacer preferably comprises a plurality of regularly spaced grooves along its length.

According to yet another aspect of the present invention, a method is provided comprising: arranging a flat display device to include two panels having a gap therebetween; preparing bar-shaped spacers; supporting first ends of the bar-shaped spacers on an edge of one of the two panels; and applying a tensile force to each of the bar-shaped spacers, while supporting the second ends of each of the bar-shaped spacers with another side of the panel.

The method preferably further comprises: arranging a first supporting member and a second supporting member outside of an active region of the panel; fixing the first ends of the spacers by respectively inserting the first ends of the spacers into supporting grooves formed on the first supporting member to support the first ends of the bar-shaped spacers; and fixing the second ends of the spacers by respectively coupling the second ends of the spacers to elastic members that apply the tensile force to the spacers mounted on the second supporting member to support the second ends of each of the bar-shaped spacers.

The method preferably further comprises: arranging a rectangular shape frame to surround an active region of the panel; wherein fixing the first ends of the spacers by respectively inserting the first ends of the spacers into grooves formed on a side of the frame to support the first ends of the bar-shaped spacers; and fixing the second ends of the spacers by coupling the second ends of the spacers with the elastic members mounted on the another side of the frame that apply the tensile force to the spacers support the second end of each of the bar-shaped spacers.

The method preferably further comprises arranging the frame and the spacers around the active region of the panel in a coupled state after coupling the spacers to the frame.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein.

DETAILED DESCRIPTION OF THE INVENTION

Figure 1A:
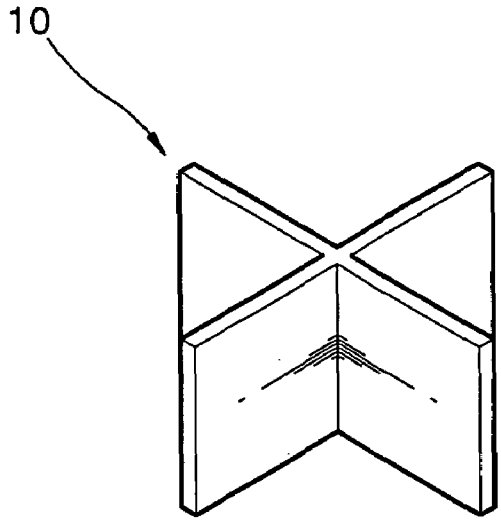
FIG. 1A (PRIOR ART)
FIGS. 1A and 1B are perspective views of two types of spacers for flat display devices.
Figure 1B:
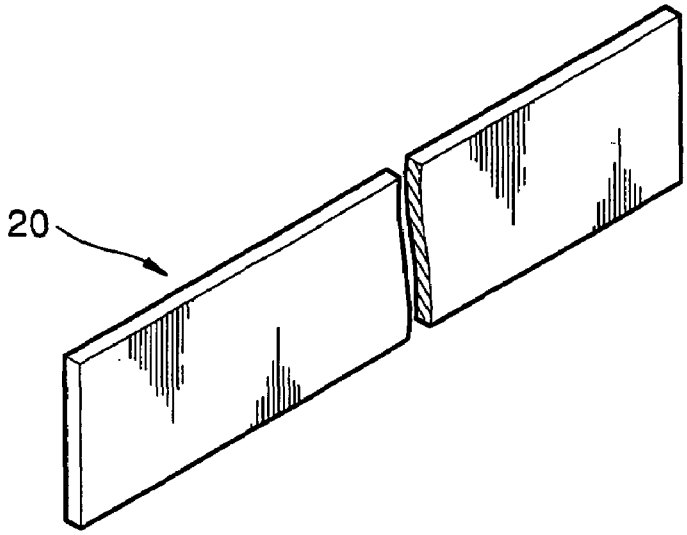
FIG. 1B (PRIOR ART)

Referring to FIGS. 1A and 1B, a cross-shaped spacer 10 and a bar-shaped spacer 20 are widely used in flat display devices.

The cross-shaped spacer 10 is manufactured piece by piece by etching or injection molding. In order to maintain the gap between the front panel and the rear panel, the cross-shaped spacer 10 is required to dispose about one~five pieces per square centimeter. Generally, the cross-shaped spacer 10 is mounted by an adhesive on the rear panel. More specifically, a small amount of the adhesive is coated on the rear panel or on the spacer 10 and then the spacer 10 is attached to the rear panel.

The cross-shaped spacer 10 can be attached to a correct location on the rear panel since it is mounted piece by piece, and almost no deformation is observed after sealing at a high temperature during the manufacturing process of flat display devices. However, mounting the numerous cross-shaped spacers 10 on the rear panel of a large flat display device can take a long time. Also, the rear panel can be contaminated by the adhesive used to attach the cross-shaped spacer 10, and the contamination of the rear panel can degrade image quality of the flat display device.

Referring to FIG. 1B, the bar-shaped spacer 20 is manufactured by cutting a ceramic sheet or a glass sheet into a bar shape with desired dimensions. The bar-shaped spacer 20 is mounted by attaching both ends of the bar-shaped spacer to a separately prepared fixture using an adhesive.

The bar-shaped spacer 20 is easily manufactured and requires a short installation time. Also, there is little possibility of contamination of an active region of the panel since the adhesive is only applied to the ends of the bar-shaped spacer 20.

However, the bar-shaped spacer 20 is not well suited to a high temperature sealing process since it only has support along one dimension. More specifically, the panel and the bar-shaped spacer 20 expand and contract by different amounts during and after the high temperature sealing process because they have different thermal expansion coefficients. Therefore, the bar-shaped spacer 20 can bend. If so, the bar-shaped spacer 20 may not remain in the correct position, resulting in misalignment of the bar-shaped spacer 20, cathodes, and anodes.

Figure 2:
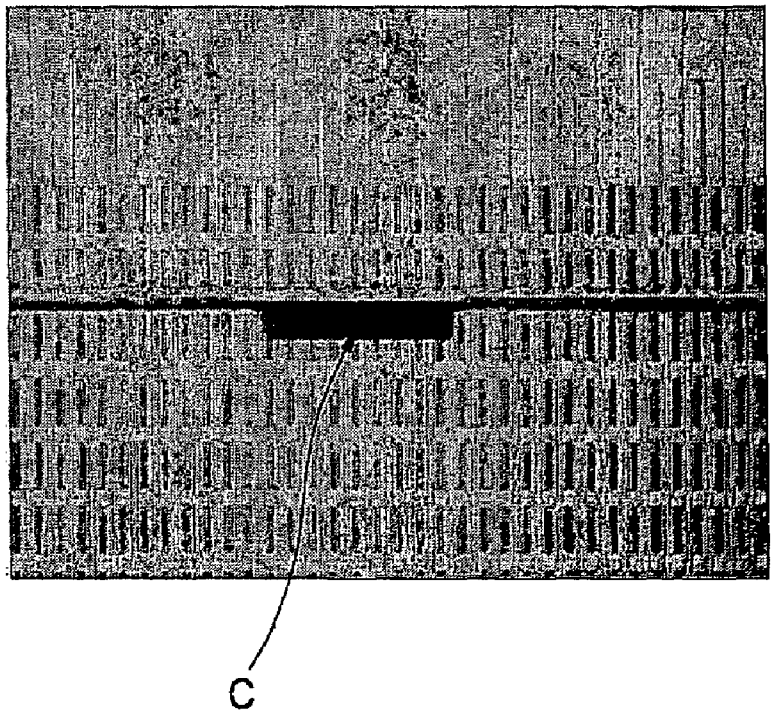
FIG. 2 (PRIOR ART)
FIG. 2 is a photographed image for explaining a problem of the bar-shaped spacer of FIG. 1B.

FIG. 2 is a view of a protrusion of a contact portion C, arranged between a spacer and the rear panel, into a pixel region due to a misalignment of a bar-shaped spacer 20 after a high temperature sealing process. When there is a misalignment of bar-shaped spacer 20, the spacer 20 may cover a pixel or interact with an electron beam between anodes and cathodes, which can cause a bright spot due to an electron charging effect, or can cause arcing by a partial distortion of an electric field.

The present invention will now be described more fully with reference to the accompanying drawings in which exemplary embodiments of the present invention are shown. Like reference numerals in the drawings denote like elements.

Figure 3:
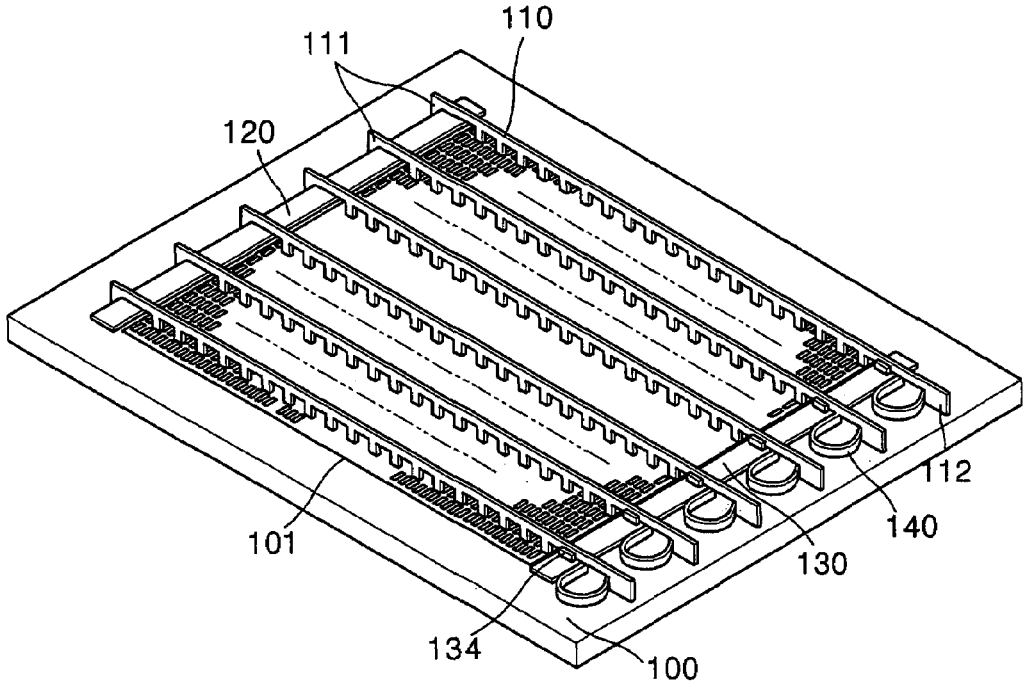
FIG. 3 (PRIOR ART)
FIG. 3 is a perspective view of a spacer supporting structure of a flat display device according to a first exemplary embodiment of the present invention.
Figure 4:
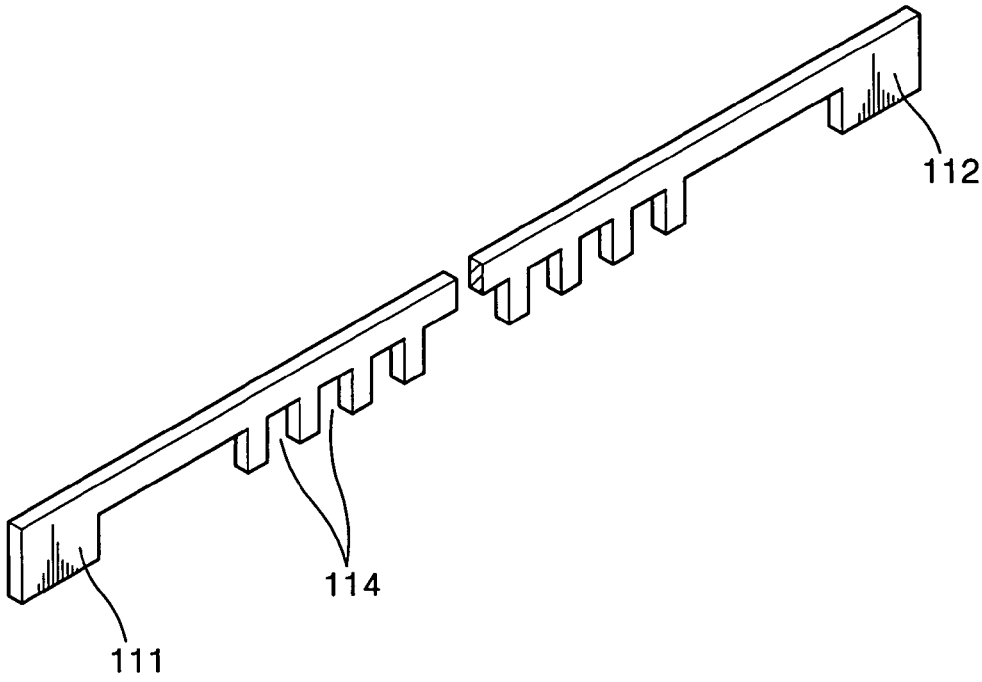
FIG. 4 is a magnified partial perspective view of a bar-shaped spacer of FIG. 3.

FIG. 3 is a perspective view of a spacer supporting structure of a flat display device according to a first exemplary embodiment of the present invention, and FIG. 4 is a magnified partial perspective view of a bar-shaped spacer depicted in FIG. 3.

Referring to FIGS. 3 and 4, a flat display device includes a front panel (not shown) and a rear panel 100, and a plurality of spacers 110 disposed therebetween to maintain a predetermined distance between the two panels.

The spacer supporting structure supports the spacers 110 and includes bar-shaped spacers 110, first and second supporting members 120 and 130, and elastic members 140.

The use of bar-shaped spacer 110 is very economical and easy to manufacture and the mounting time is also very short.

The bar-shaped spacer 110 can be manufactured by cutting a ceramic sheet or a glass sheet into thin pieces. The bar-shaped spacer 110 has a thickness of approximately 60~70 μm. However, the length can vary according to the length of the flat display device. A height of the bar-shaped spacer 110 can also vary according to the gap between the front panel and the rear panel 100. For example, in the present invention, the gap ranges between hundreds of μm and several mm.

Referring to FIG. 4, the bar-shaped spacer 110 includes a first coupling portion 111 and a second coupling portion 112. The first coupling portion 111 and the second coupling portion 112 are respectively coupled with the first supporting member 120 and the elastic member 140.

Grooves 114 are spaced regularly along the length of the space bar 110. The grooves 114 allow fluent passage of an inert gas injected between the front panel and the rear panel 100 to prevent oxidation of an electron emitter during a high temperature process. Also, the grooves 114 allow for discharging the gas when vacuuming the space between the front panel and the rear panel 100 after sealing the two panels.

The first supporting member 120 and the second supporting member 130 can be attached to one of the two panels, but are preferably attached to the rear panel 100. The first supporting member 120 is fixed to an edge portion of a side of the rear panel 100. More specifically, the first supporting member 120 is bar-shaped and is attached to a surface of the rear panel 100 using an adhesive parallel to an edge of the active region 101 of the rear panel 100. The first supporting member 120 fixes an end of the bar-shaped spacer 110.

Figure 5:
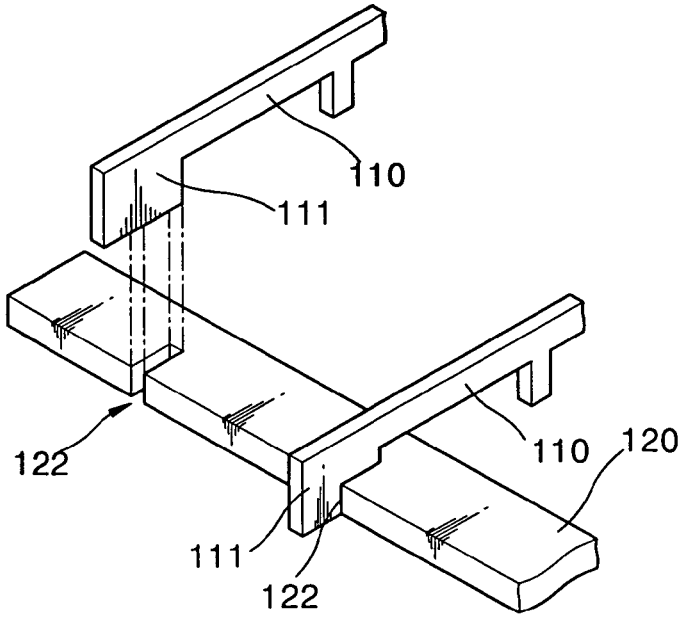
FIG. 5 is a magnified partial perspective view illustrating how a first supporting member is connected to a spacer of FIG. 3.

FIG. 5 is a view of the bar-shaped spacer 110 connected the first supporting member 120.

Referring to FIG. 5, supporting grooves 122 can be formed in the first supporting member 120, and an end of the bar-shaped spacer 110, i.e., the first coupling portion 111, is inserted in each of the supporting grooves 122. Each supporting groove 122 can have a width small enough that the first coupling portion 111 is tightly fixed therein. To further fix the first supporting member 120 and the spacer 110, an adhesive can be coated in the supporting grooves 122.

Referring to FIG. 3, the second supporting member 130 is disposed on an opposite edge portion of the rear panel 100. More specifically, the second supporting member 130 is also bar-shaped, and is attached to a portion of the rear panel 100 using an adhesive parallel to the opposite edge of the active region 101 of the rear panel 100. The second supporting member 130 fixes the elastic member 140.

The first supporting member 120 and the second supporting member 130 can be composed of the same material as the rear panel 100. In this case, a problem of separation due to different expansion and contraction in a high temperature process can be prevented because the rear panel 100, the first supporting member 120, and the second supporting member 130 have the same thermal expansion coefficient. Therefore, when the rear panel 100 is formed of glass, the first and the second supporting member 120 and 130 can be also formed of glass.

The elastic member 140 is mounted on the second supporting member 130 and attached to an end of the bar-shaped spacer 110. The elastic member 140 applies a tension force to the bar-shaped spacer 110.

Figure 6:
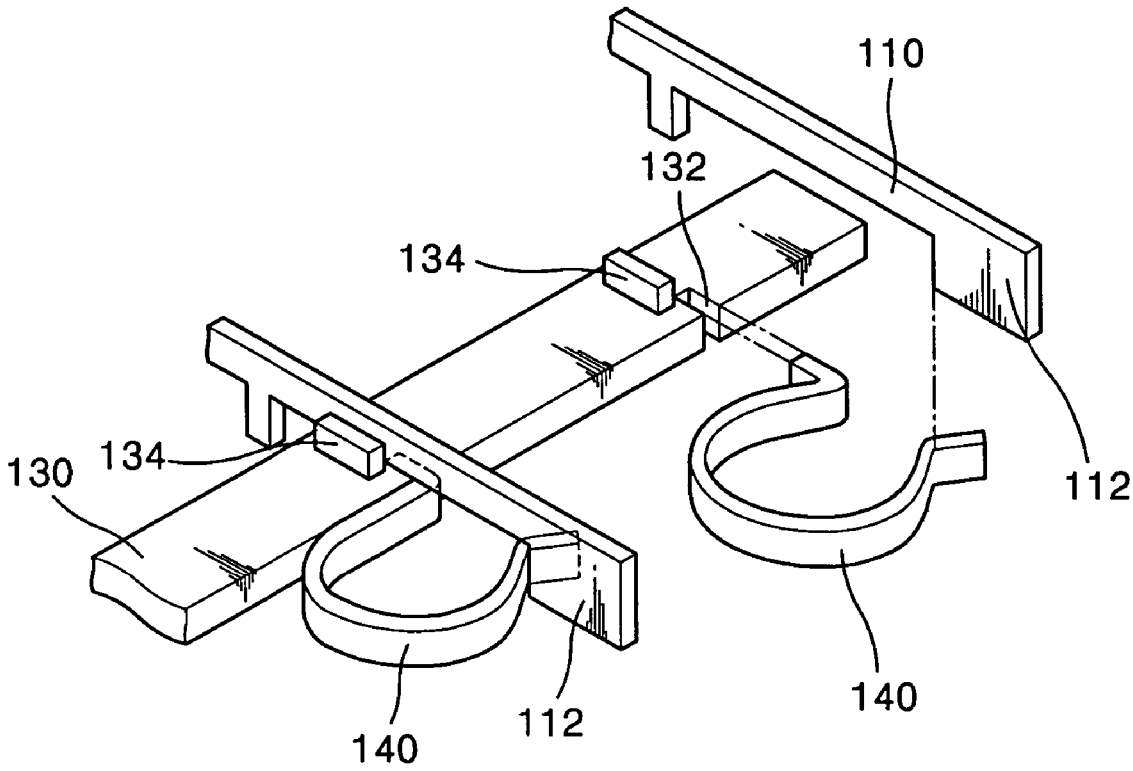
FIG. 6 is a partial perspective view illustrating a second supporting member, the spacer, and an elastic member of FIG. 3.

FIG. 6 is a perspective view of the second supporting member 130, the bar-shaped spacer 110, and the elastic member 140.

Referring to FIG. 6, the elastic member 140 is a leaf spring, with one end attached to the second supporting member 130 and the other end coupled to an end of the bar-shaped spacer 110. Mounting grooves 132 are formed in the second supporting member 130, and an end of the leaf spring 140 is inserted into one of the mounting grooves 132. The leaf spring 140 is bent into an omega shape Ω to provide a sufficient elastic restoration force despite a small size, and the other end of the leaf spring 140 is bent into a V shape for easy coupling to the second coupling portion 112 of the bar-shaped spacer 110. Therefore, a tensile force is applied to the bar-shaped spacer 110 by the leaf spring 140.

The elastic member 140 can have any shape that facilitates the performing of the same function as described above using the leaf spring.

When a tensile force is applied to the bar-shaped spacer 110, the bar-shaped spacer 110 does not easily bend even if the bar-shaped spacer 110 expands or contracts during a high temperature process. Therefore, alignment errors between the bar-shaped spacer 110, the cathode, and the anode can be minimized. Also, because of the tensile force, the structure of the bar-shaped spacer 110 is not easily distorted by the flow of an inert gas for preventing oxidation of the emitter during a high temperature process.

The spacer supporting structure according to the present embodiment further includes a guide member 134 to guide the bar-shaped spacer 110, the guide member 134 being arranged adjacent to the second coupling portion 112. The guide member 134 can be formed to protrude from on a surface of the second supporting member 130 adjacent to a side surface of the bar-shaped spacer 110. The guide member 134 also can be formed as a single body with the second supporting member 130. The guide member 134 prevents distortion in the expansion direction when the bar-shaped spacer 110 is expanded during a high temperature process.

In FIG. 6, the guide member 134 is located on a side of the bar-shaped spacer 110. However, guide members 134 can be disposed on both sides of the bar-shaped spacer 110 so as to oppose each other. When the guide members 134 are disposed on both sides of the bar-shaped spacer 110, the gap between the two guide members 134 is large enough that the bar-shaped spacer 110 can freely expand or contract.

Figure 7:
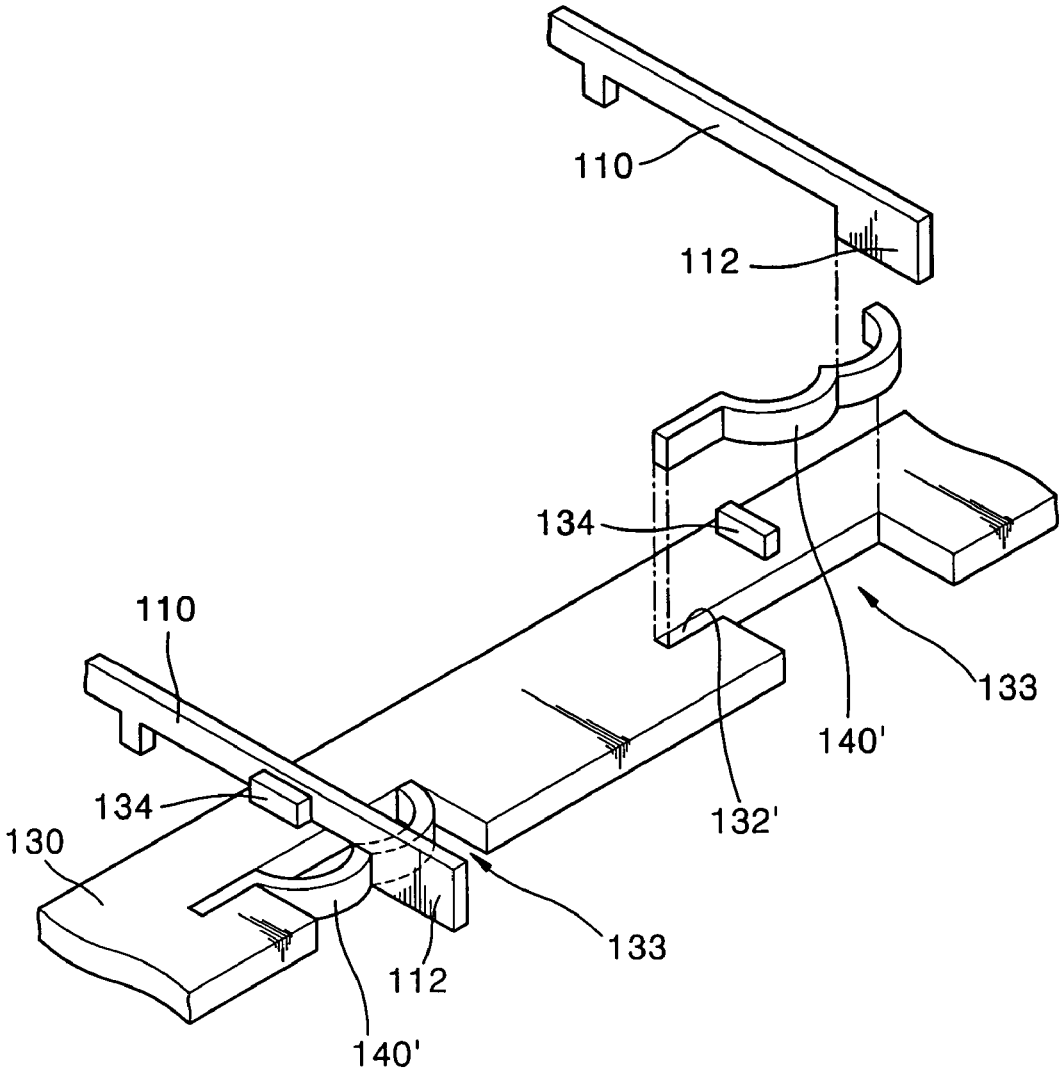
FIG. 7 is a partial perspective view illustrating a modified version of an elastic member along with a second supporting member and a spacer.

FIG. 7 is a perspective view of a modified version of an elastic member 140' along with the second supporting member 130 and the bar-shaped spacer 110.

Referring to FIG. 7, the elastic member 140' is a wing-shaped leaf spring. An inserting groove 133 into which the elastic member 140' can be inserted is formed in the second supporting member 130. A mounting groove 132' into which an end of the elastic member 140' can be inserted and tightly fixed is formed in a corner of the inserting groove 133. The other end of the elastic member 140' is fixed by contacting another corner of the inserting groove 133. An almost central region of the elastic member 140' is bent in a V shape to be easily coupled with the second coupling portion 112 of the spacer 110. Therefore, a tensile force is applied to the bar-shaped spacer 110.

Also, a guide member 134 for guiding the bar-shaped spacer 110 can be used with the elastic member 140'.

The function and effect of the elastic member 140' are the same as those of the elastic member 140, and accordingly, a detailed description thereof has been omitted. Since the shape of the modified version of the elastic member 140' is simpler than the elastic member 140 of FIG. 6, the elastic member 140' is more easily manufactured. Also, the elastic member 140' does not protrude outside of the second supporting member 130, and therefore, a size of the rear panel 100 can be reduced.

Figure 8:
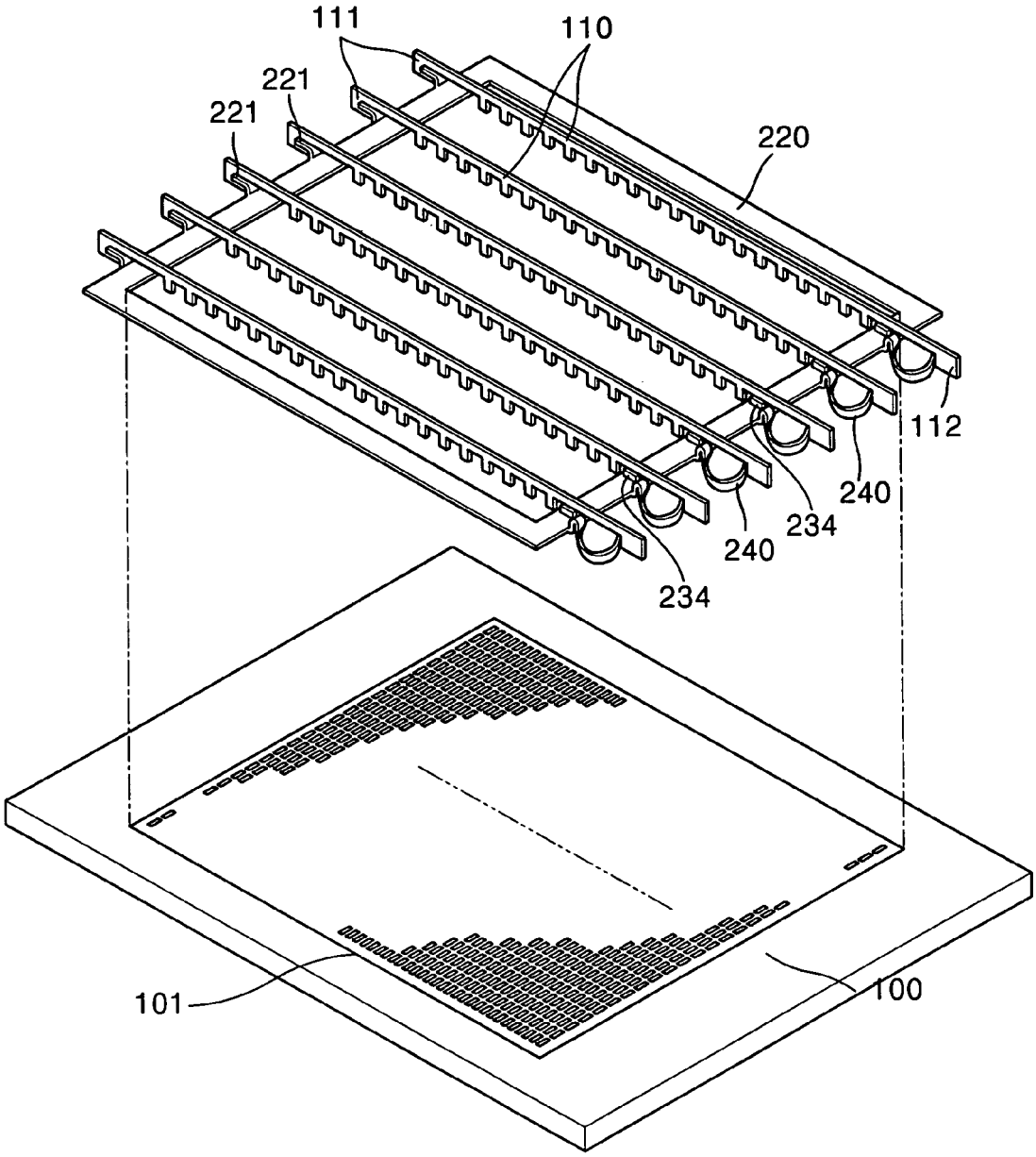
FIG. 8 is an exploded perspective view of a spacer supporting structure of a flat display device according to a second embodiment of the present invention.

FIG. 8 is a perspective view of a spacer supporting structure of a flat display device according to a second embodiment of the present invention.

Referring to FIG. 8, the spacer supporting structure includes a bar-shaped spacer 110, a rectangular-shaped frame 220, a supporting member 221 and an elastic member 240 disposed on the frame 220.

In the present embodiment, the same bar-shaped spacer 110 is used as in the previous embodiment, and accordingly, a detailed description thereof has been omitted.

The frame 220 supports a plurality of bar-shaped spacers 110, has a rectangular shape and surrounds the active region 101 of the rear panel 100. The frame 220 can be attached to a surface of the rear panel 100 by an adhesive.

The frame 220 can be composed of a metal to have a high strength and can be formed in a single body including supporting members 221 and elastic members 240 which will be described later. The frame 220 can be composed of a metal having a similar thermal expansion coefficient to the thermal expansion coefficient of the rear panel 100 formed of a glass substrate, such as an Invar or a nickel alloy, thereby preventing a separation of the frame 220 from the rear panel 100 due to the thermal expansion and contraction in a high temperature process.

The supporting member 221 is disposed on a side of the frame 220 and fixes an end of the bar-shaped spacer 110.

The elastic member 240 is disposed on the opposite side of the frame 220 and is coupled to the other end of the bar-shaped spacer 110. The elastic member 240 applies a tensile force to the bar-shaped spacer 110.

Figure 9:
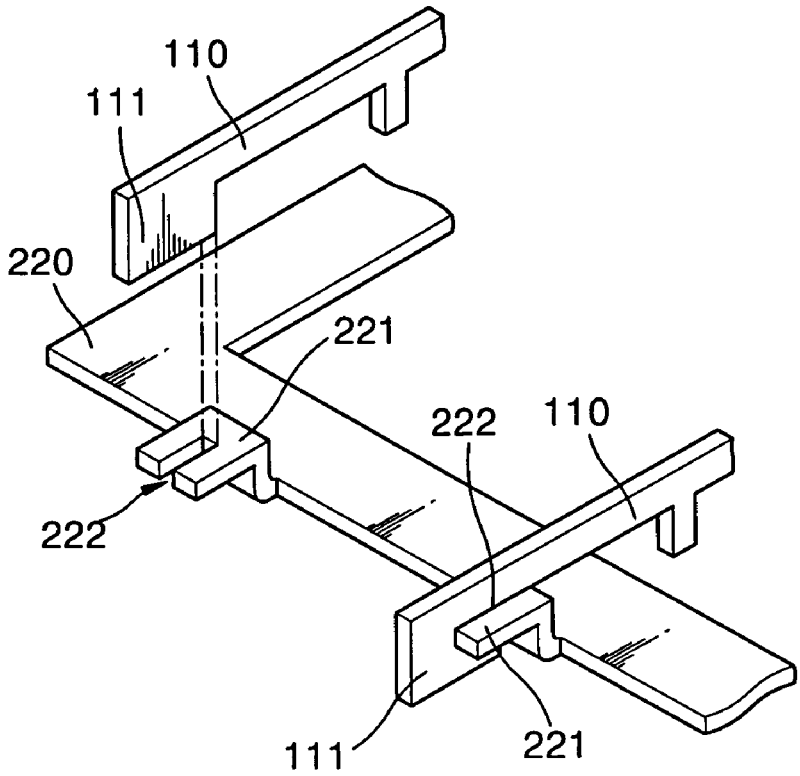
FIG. 9 is a partial perspective view of a spacer coupled with a frame of FIG. 8.

FIG. 9 is a partial perspective view of the bar-shaped spacer 110 coupled to the frame 220.

Referring to FIG. 9, the supporting members 221 can be formed as a unitary structure with the frame 220. More specifically, the frame 220 is formed of a thin metal sheet, and so the supporting members 221 can be formed on an edge of the frame 220 in a unitary structure with the frame 220 by bending the metal sheet. On the other hand, the supporting members 221 can be separately manufactured and attached to the frame 220.

A supporting groove 222 can be formed in each of the supporting members 221. The first coupling portion 111 of the spacer 110 is inserted and fixed tightly in the supporting groove 222. Preferably, the supporting groove 222 has a width small enough to be inserted in the first coupling portion 111 and fixed tightly. An adhesive further strengthening the coupling can be coated between the supporting member 221 and the first coupling portion 111.

Figure 10:
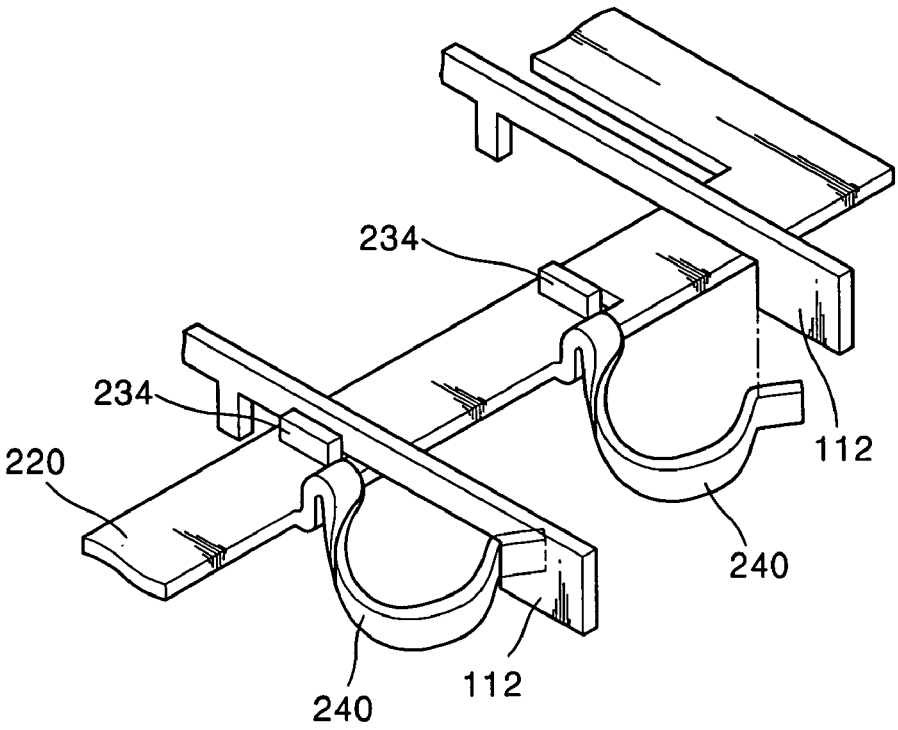
FIG. 10 is a partial perspective view illustrating a frame, a spacer, and an elastic member depicted in FIG. 8.

FIG. 10 is a partial perspective view of the frame 220, the bar-shaped spacer 110, and the elastic member 240.

Referring to FIG. 10, the elastic member 240 can be composed of a leaf spring with an end attached to the frame 220 and the other end of the leaf spring coupled to the second coupling portion 112 of the spacer 110. The leaf spring 240 can also be formed by bending the frame 220 as a unitary structure, like the supporting member 221. Accordingly, an end of the leaf spring 240 is fixed on the frame 220. The elastic member 240 can be formed in any shape as long as it can perform the functions described above. The shape and function of the elastic member 240 are the same as in the previous embodiment, and accordingly, a detailed description thereof has been omitted.

The spacer supporting structure according to the second exemplary embodiment can further include a guide member 234 to guide the bar-shaped spacer 110, disposed adjacent to the second coupling portion 112 of the spacer 110. The guide member 234 has a protruded form and is located on a surface of the frame 220 adjacent to a side of the bar-shaped spacer 110. The guide member 234 can be formed by cutting and bending the frame 220. Detailed descriptions of the functions of the guide member 234 have been omitted since they are the same as in the previous embodiment. Also, the guide member 234 can be disposed on a side of the bar-shaped spacer 110 or a pair of guide members 234 can be disposed on opposite sides of the bar-shaped spacer 110 as in the previous embodiment.

The spacer supporting structure according to the second exemplary embodiment of the present invention has the same effect as the spacer supporting structure of the first exemplary embodiment. Moreover, according to the second exemplary embodiment, after mounting the bar-shaped spacer 110 on the frame 220, the frame 220 can be mounted on a circumference of the active region 101 of the rear panel 100. Therefore, the second exemplary embodiment is advantageous in handling and mounting over the first exemplary embodiment in which a plurality of bar-shaped spacers 110 are attached to the first and second supporting members 120 and 130 after attaching the first and second supporting members 120 and 130 on the rear panel 100.

Figure 11:
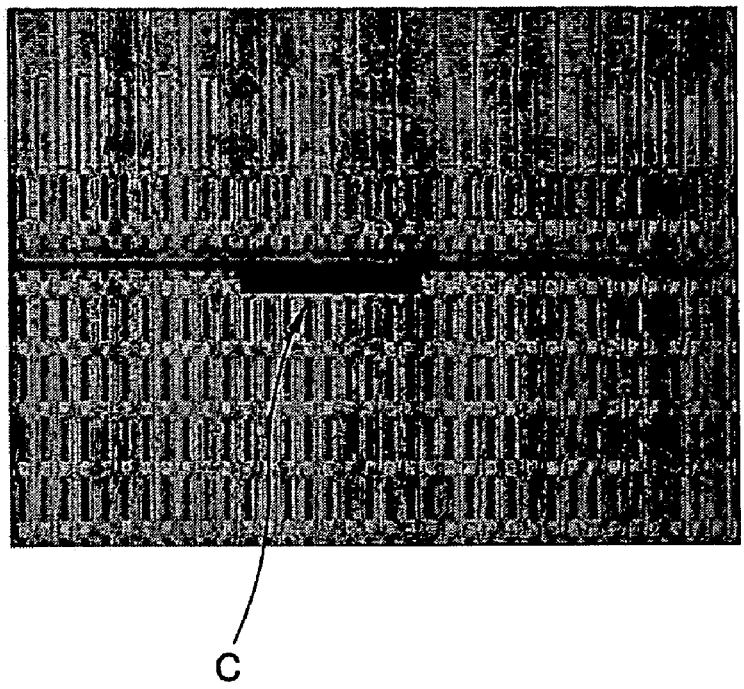
FIG. 11 is a photographed image of an alignment state of a spacer after a high temperature process in which a spacer supporting structure according to an embodiment of the present invention is used.

FIG. 11 is a photographed image of an alignment state of a bar-shaped spacer after a high temperature process in which a spacer supporting structure according to the present invention is used.

Referring to FIG. 11, it is seen that a contact part C between the spacers 110 and the rear panel is correctly located in the space between the pixels after a high temperature treatment. That is, according to an embodiment of the present invention, the alignment of the spacers is undisturbed while being expanded and contracted during a high temperature process, and is not affected by the flow of the injected inert gas.

According to the above description, the spacer supporting structure and the method of supporting the spacers according to the present invention has the following advantages.

First, since bar-shaped spacers are used, the manufacturing of the spacers is much easier than they would be if the cross-shaped spacers were used, and the time required for mounting can be remarkably reduced. There is no possibility of contamination by an adhesive since the coupling is made without an adhesive in the active region of the panel.

Second, since a tensile force is applied to the bar-shaped spacer, a problem of bending due to the expansion and contraction in a high temperature process can be prevented, thereby minimizing alignment errors between the spacers, the cathode, and the anode. Also, an alignment error caused by the flow of an inert gas injected between the two panels for preventing the oxidation of the electron emitter during a high temperature process can also be prevented.

While the present invention has been particularly shown and described with reference to exemplary embodiments thereof, it will be understood by those skilled in the art that various modifications in form and detail can be made therein without departing from the spirit and scope of the invention as defined by the appended claims.

What is claimed is:

1. A spacer supporting structure of a flat display device including two panels, the spacer supporting structure comprising:

a plurality of bar-shaped spacers;

a first supporting member adapted to fix first ends of the spacers, the first supporting member arranged at an edge of one of the two panels;

a second supporting member arranged on another edge of the one of the two panels; and a plurality of elastic members arranged on the second supporting member, the plurality of elastic members being coupled to second ends of the spacers and adapted to apply a tensile force to respective spacers.

2. The spacer supporting structure of claim 1, further comprising a groove arranged in the first supporting member, the first end of the each of the spacers being inserted and fixed in the groove.

3. The spacer supporting structure of claim 1, wherein each of the elastic members comprises a leaf spring, one end thereof being fixed to the second supporting member and another end thereof being coupled to the second end of one of the spacers.

4. The spacer supporting structure of claim 3, wherein each of the elastic members has an omega shape.

5. The spacer supporting structure of claim 3, wherein the second supporting member comprises grooves adapted to support ends of the leaf springs, the ends of each leaf spring being inserted into respective grooves.

6. The spacer supporting structure of claim 1, wherein each of the elastic members comprises a wing shape leaf spring, one end thereof being fixed to the second supporting member and a central part thereof being coupled to the second end of one of the spacers.

7. The spacer supporting structure of claim 6, further comprising an inserting groove arranged in the second supporting member, wherein one of the elastic members is adapted to being inserted into the inserting groove, and further comprising a mounting groove adapted to support an end of one of the leaf springs, the end of the one of the leaf spring being inserted into the mounting groove and arranged on a corner portion of the inserting groove.

8. The spacer supporting structure of claim 1, further comprising a plurality of guides adapted to guide the respective spacers so as not to deviate from an expansion direction, the plurality of guides being respectively arranged adjacent to the second ends of the spacers.

9. The spacer supporting structure of claim 8, wherein the plurality of guides comprise guide members protruding from respective surfaces of the second supporting members, the guide members being arranged adjacent to a side of the respective spacers.

10. The spacer supporting structure of claim 9, wherein each of the guide members comprises a unitary structure with the second supporting member.

11. The spacer supporting structure of claim 1, wherein each of the first and second supporting members is attached to a surface of the panel parallel to an edge of an active region of the panel.

12. The spacer supporting structure of claim 1, wherein the first and the second supporting members comprise the same material as the panel.

13. The spacer supporting structure of claim 12, wherein the first and the second supporting members comprise glass.

14. The spacer supporting structure of claim 1, wherein each end of the spacers comprises a coupling portion.

15. The spacer supporting structure of claim 1, wherein each spacer comprises a plurality of regularly spaced grooves along its length.

16. A spacer supporting structure of a flat display device including two panels, the spacer supporting structure comprising:

a plurality of bar-shaped spacers;

a rectangular shaped frame adapted to surround an active region of one of the two panels;

a plurality of supporting members adapted to fix respective first ends of the spacers, the plurality of supporting members being arranged on a side of the frame; and a plurality of elastic members arranged on another side of the frame, the plurality of elastic members being coupled to the second ends of the spacers and adapted to apply a tensile force to the respective spacers.

17. The spacer supporting structure of claim 16, wherein each of the plurality of supporting members comprises a supporting groove adapted to support the respective spacer, the first end of each spacer being arranged in its respective groove, and wherein the plurality of supporting members comprise a unitary structure with the frame.

18. The spacer supporting structure of claim 16, wherein each of the plurality of elastic members comprises a leaf spring, first ends thereof being fixed to another side of the frame and second ends thereof being respectively coupled to the second ends of the respective spacers.

19. The spacer supporting structure of claim 18, wherein the leaf springs comprise a unitary structure with the frame.

20. The spacer supporting structure of claim 16, further comprising a plurality of guides adapted to guide the respective spacers so as not to deviate from an expansion direction, the plurality of guides being respectively arranged adjacent to the second ends of the spacers.

21. The spacer supporting structure of claim 20, wherein the plurality of guides comprise guide members protruding from surfaces of the another side of the frame adjacent to a side of the respective spacers spacer.

22. The spacer supporting structure of claim 21, wherein the guide members are formed by cutting and bending the frame.

23. The spacer supporting structure of claim 16, wherein the frame comprises a metal.

24. The spacer supporting structure of claim 23, wherein the frame comprises one of Invar and a nickel alloy.

25. The spacer supporting structure of claim 16, wherein the frame on which the spacers are mounted is arranged around the active region of the panel.

26. The spacer supporting structure of claim 16, wherein each of the end parts of the spacers comprises a coupling portion.

27. The spacer supporting structure of claim 16, wherein each spacer comprises a plurality of regularly spaced grooves along its length.

* * * * *